US007448453B2

(12) United States Patent
Tobin

(10) Patent No.: US 7,448,453 B2
(45) Date of Patent: Nov. 11, 2008

(54) FLIP-OVER PUSH/BACK-DRAG BLADE ATTACHMENT FOR WORK VEHICLES

(76) Inventor: Jason T. Tobin, 504 S. Fillmore, Maryville, MO (US) 64468

( * ) Notice: Subject to any disclaimer, the term of this patent is extended or adjusted under 35 U.S.C. 154(b) by 463 days.

(21) Appl. No.: 11/065,687

(22) Filed: Feb. 24, 2005

(65) Prior Publication Data

US 2005/0194161 A1 Sep. 8, 2005

Related U.S. Application Data

(60) Provisional application No. 60/547,351, filed on Feb. 24, 2004.

(51) Int. Cl.
*E02F 3/76* (2006.01)

(52) U.S. Cl. ..... 172/821; 172/817; 172/828

(58) Field of Classification Search ..... 172/741, 172/743, 781, 785, 795, 797, 815, 817, 824, 172/825, 826; 37/263, 266, 267, 268, 234, 37/454, 407

See application file for complete search history.

(56) References Cited

U.S. PATENT DOCUMENTS 1,572,824 A * 2/1926 Tatge ..... 37/283
2,227,624 A * 1/1941 Benbow et al. ..... 37/408
2,622,349 A * 12/1952 Kinnan ..... 172/445.2
2,657,481 A * 11/1953 Larsen ..... 37/444
2,787,847 A * 4/1957 Arps ..... 172/445.2
2,815,138 A * 12/1957 Noffsinger ..... 414/702
2,815,591 A * 12/1957 Mattingly ..... 172/445.2
3,319,366 A 5/1967 Thompson
3,587,751 A * 6/1971 Schmidt ..... 172/264
3,598,186 A * 8/1971 Coontz ..... 172/445.2
3,808,714 A * 5/1974 Reissinger et al. ..... 37/233
4,058,174 A 11/1977 Atherton et al.
4,060,136 A 11/1977 Hendrickson et al.
4,074,767 A 2/1978 Cole
4,084,643 A 4/1978 Easterling
4,105,078 A 8/1978 Gilbert
4,369,590 A * 1/1983 Miller ..... 37/231
5,413,181 A * 5/1995 Keigley ..... 172/253
5,667,020 A 9/1997 Palmer et al.
5,974,702 A * 11/1999 Donoghue ..... 37/263
6,314,666 B1 11/2001 Klemenhagen et al.
6,453,582 B1 * 9/2002 Fulton, III ..... 37/197

OTHER PUBLICATIONS

Brochure—Bobcat Snow Blade Attachment "One Tough Animal" (Front and Back) Ref. No. N-10M-1104-#653129-F.

(Continued)

*Primary Examiner*—Thomas B Will
*Assistant Examiner*—Joel F Mitchell
(74) *Attorney, Agent, or Firm*—Hovey Williams LLP

(57) ABSTRACT

A vehicle-mounted tool, such as a blade, may be disposed in an upright position for dozing or other pushing functions when the vehicle moves forwardly and then flipped over into an inverted position for back-dragging or the like when the vehicle moves in reverse. Flipping of the blade is accomplished using a cylinder operated from the seat of the vehicle. The blade is mounted on a swivel head that is controlled by a pair of oppositely actuating swivel cylinders from the operator's seat so that whether the blade is upright or inverted, it may be swivelled left or right into any number of obliquely disposed positions.

13 Claims, 10 Drawing Sheets

OTHER PUBLICATIONS

Brochure—Bobcat Grader Attachment "One Tough Animal" (Front and Back) Ref. No. KnB-15M-203-#6000285F.
Brochure—Bobcat Dozer Blade Attachment "One Tough Animal" (Front and Back) Ref. No. Kn-10M-205-#B6336505F.
Brochure—Hiniker High-Performance Tri-Edge Snowplows (date code Apr. 2004) (4 pgs).
Brochure—Hiniker C-Plow (Aug. 2001) (2 pgs).
Brochure—Fox Skid Steer Mounted Snowplows (Aug. 2003) (4 pgs).
Brochure—Hiniker C-Plow (Oct. 2002) (2 pgs).
Operator Manual—Hiniker Operator Manual (pp. 6,7,14 and 15).

* cited by examiner

FLIP-OVER PUSH/BACK-DRAG BLADE ATTACHMENT FOR WORK VEHICLES

RELATED APPLICATIONS

This application claims the priority benefit of provisional patent application No. 60/547,351 filed Feb. 24, 2004, said provisional application being hereby incorporated by reference into the present specification.

TECHNICAL FIELD

This invention relates to earth-working vehicles and, more particularly, to an attachment for such vehicle in which the earth-working tool, such as a blade, may be flipped between upright and inverted positions from the operator's seat to quickly and easily switch between pushing and back-dragging functions.

BACKGROUND AND SUMMARY

Various front end attachments for relatively small, utility type work vehicles are well known in the art. The present invention is directed to an attachment having a tool, such as a blade, that can be flipped from the operator's seat between an upright position for pushing operations when the vehicle is moved forwardly or back-dragging operations when the vehicle is moved in reverse. The blade can also be swivelled between a wide variety of left and right oblique positions so as to greatly increase the utility and ease of use of the blade.

In one preferred form, the backside of the blade is pivotally attached to a support of the attachment for flip-over movement about a transverse axis located in the lower half of the blade. A single hydraulic piston and cylinder unit is pivotally attached to the support above the blade and is operably connected to the blade at a pivot point located somewhat above the mounting point of the blade to the support. When the cylinder is in a retracted condition, the blade is maintained in an upright position with the concave side facing forwardly for pushing operations, but when the cylinder extends, the blade flips over with the concave side now facing rearwardly so as to prepare for back-drag operations and the like. Preferably, both the blade and the flip cylinder are mounted on a swivel head of the support which can be swivelled left and right about an upright axis by a pair of alternately moving cylinders so as to position the blade in any one of a number of left and right oblique positions, whether the blade is upright or inverted.

BRIEF DESCRIPTION OF THE DRAWINGS

FIG. 11 is a front elevational view showing the blade in its inverted position and swivelled in such a manner that one corner of the blade is lower than the other so as to facilitate use of the blade for trenching operations and the like.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
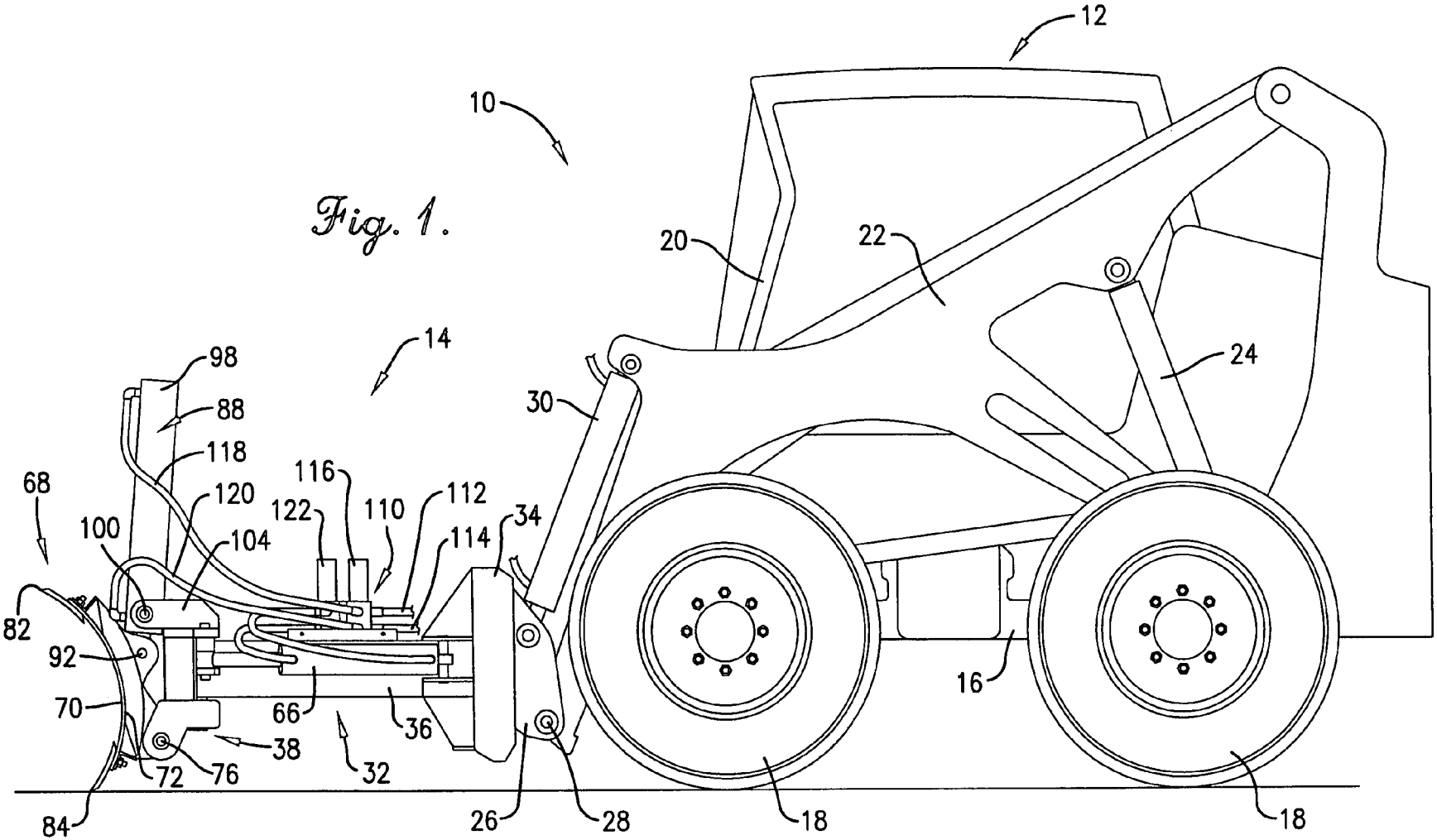
FIG. 1 is a side elevational view of earth working apparatus in accordance with the principles of the present invention, including a work vehicle having a front end attachment constructed in accordance with the principles of the present invention.
Figure 2:
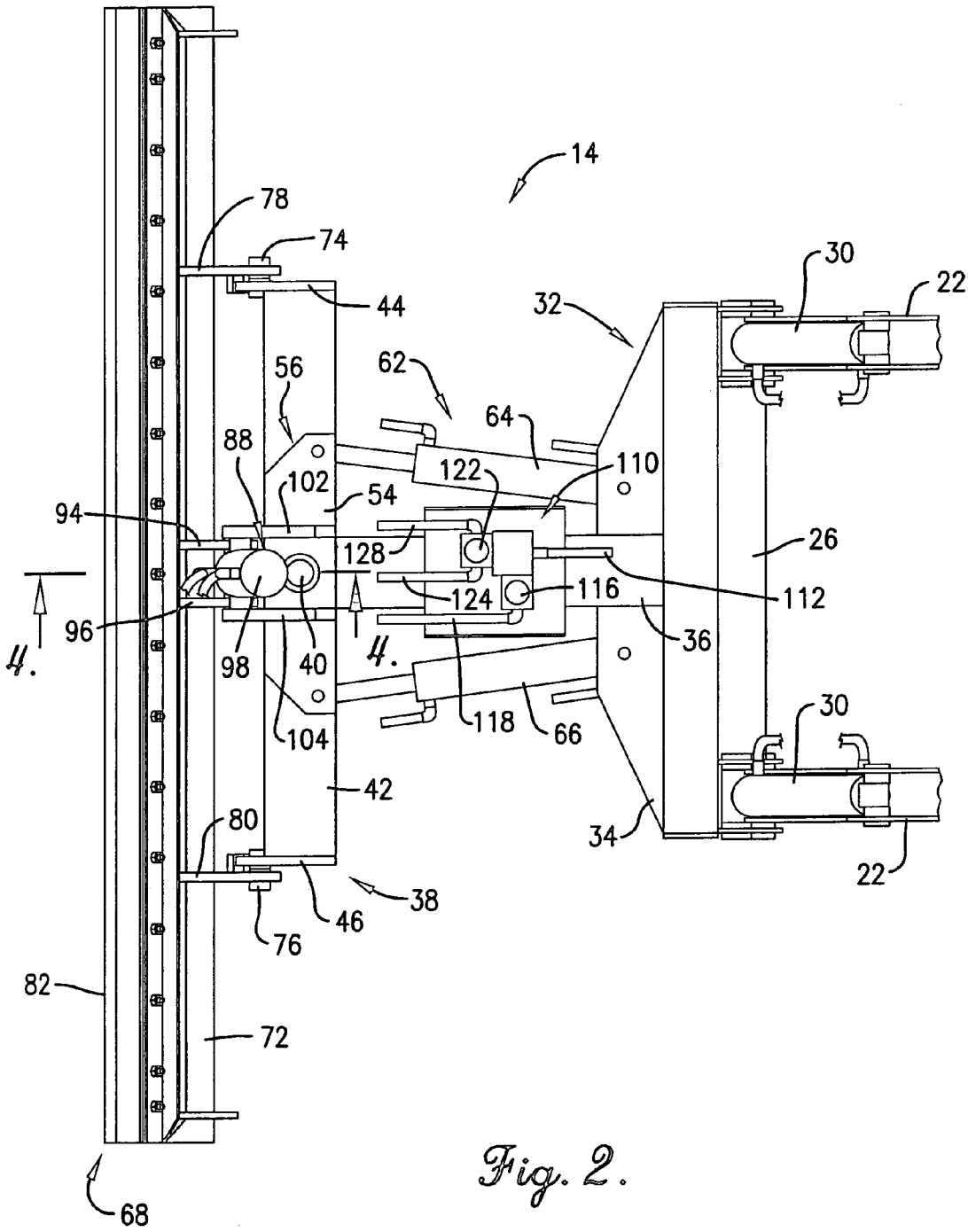
FIG. 2 is a top plan view of the attachment and fragmentarily shown lift arms of the vehicle.

The ground-working apparatus 10 in FIG. 1 includes a utility work vehicle 12 and a front end attachment 14 carried by vehicle 12 Although vehicle 12 may take a variety of different forms within the principles of the present invention, one vehicle that has been found to be particularly appropriate is the Model 873 BOBCAT vehicle available from Bobcat Company of West Fargo, N.Dak. As is well known, such vehicles 12 are typically provided with a chassis 16 having ground wheels 18 and an operator's platform 20 having a seat (not shown). Lift arms 22 are raised and lowered by hydraulic cylinders 24 (only one being shown), and a mounting adaptor 26 is pivotally attached to arms 22 at their lower front ends. Adaptor 26 is of standard design as well known by those skilled in the art and is adapted to be cocked fore-and-aft about its transverse pivotal connections 28 with arms 22 by hydraulic cylinders 30.

Attachment 14 includes a support 32 that is generally I-shaped when viewed in top plan. At one end, support 32 has a transversely extending base 34 that releasably couples on its backside with daptor 26 in the well-known manner. Support 32 also includes a fore-and-aft bar 36 fixed at its rear end to base 34 adjacent its center and a swivel head 38 at the front end of bar 36. Swivel head 38 is adapted for left and right swivelling movement about an upright axis defined by a pivot shaft 40.

Figure 4:
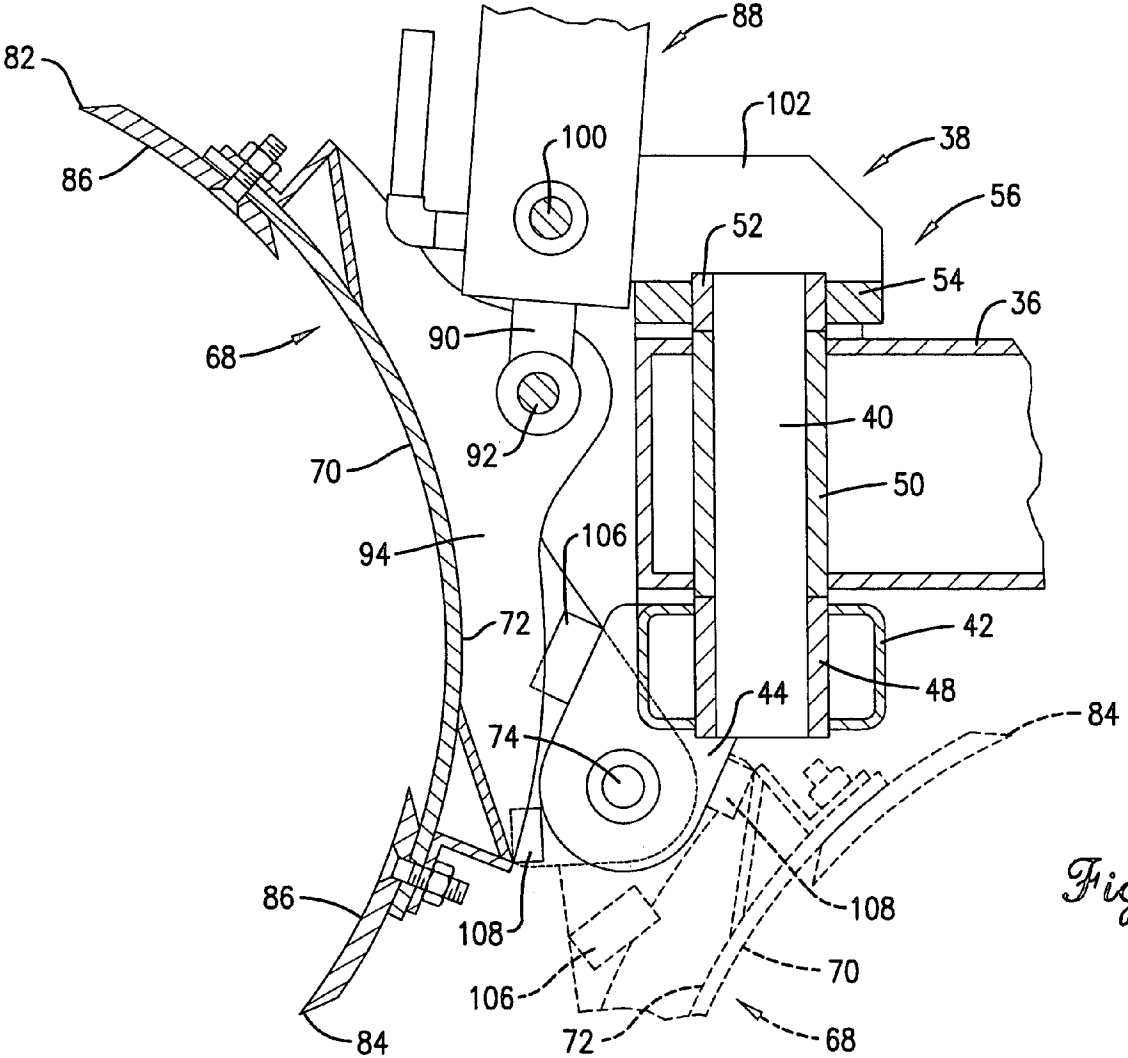
FIG. 4 is an enlarged, fragmentary vertical cross-sectional view through the blade and adjacent mounting structure illustrating details of construction.
Figure 8:
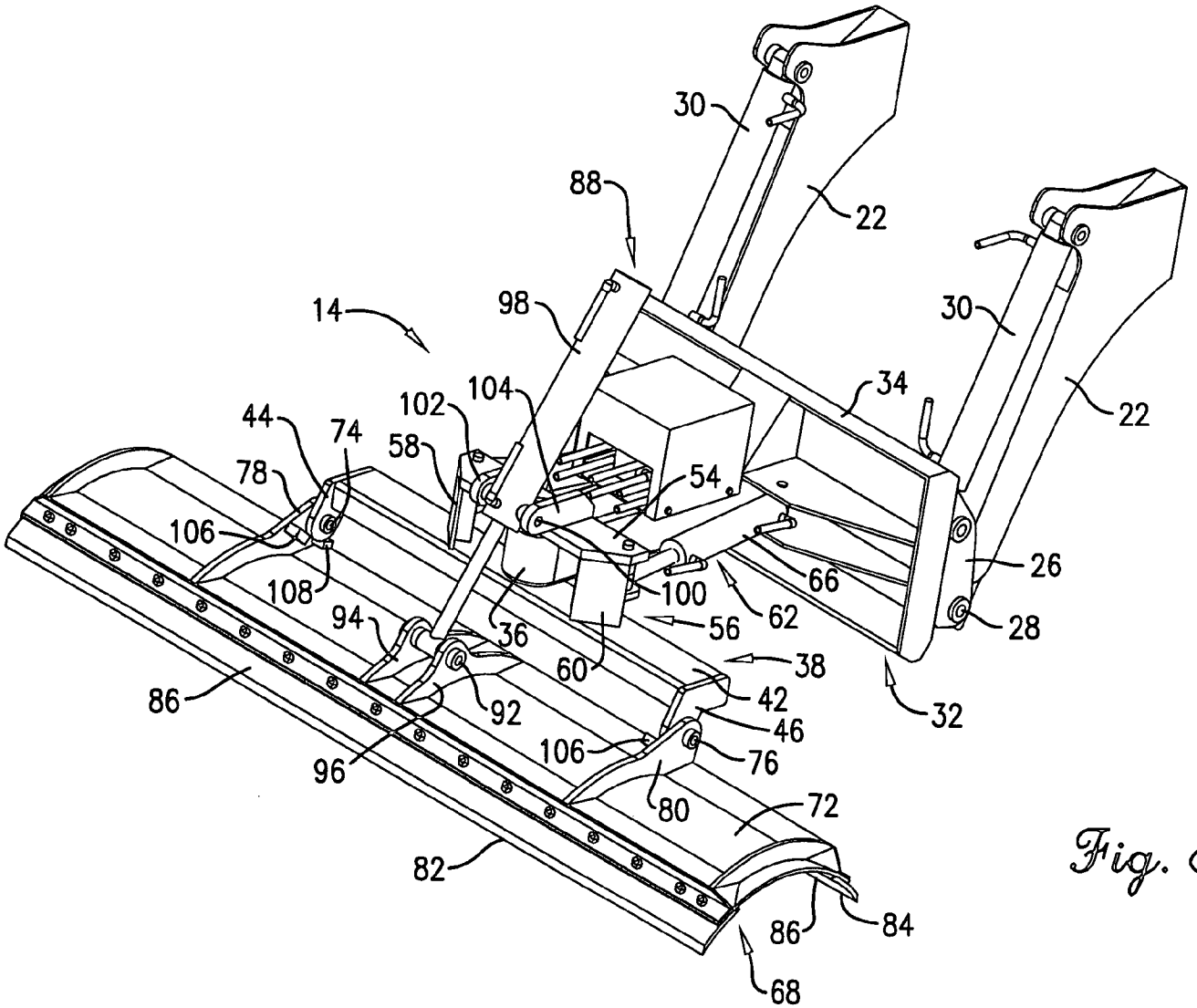
FIG. 8 is an isometric view similar to FIG. 7 but showing the blade partially flipped over and with the housing for the hydraulic valve bank fully in place.

As shown particularly in FIG. 8, swivel head 38 includes an elongated, normally transversely extending tubular beam 42 having a pair of mounting lugs 44 and 46 projecting downwardly and slightly forwardly from opposite ends thereof. As shown in FIG. 4, beam 42 contains a short upright sleeve 48 fixed within its interior at the longitudinal midpoint of the beam 42. Sleeve 48 is aligned with a second, taller sleeve 50 fixed within the interior of bar 36, which is also tubular. Above sleeve 50, a third short sleeve 52 is securely fixed to a horizontal, transversely extending plate 54 that comprises part of a cylinder mount broadly denoted by the numeral 56 and hereinafter explained in more detail. Plate 54 is supported above cross beam 42 by a pair of upstanding end members 58 and 60 that are rigidly affixed at their lower ends to beam 42.

In the particular illustrated embodiment, swivel shaft 40 is welded or otherwise affixed at its upper end to sleeve 52 associated with mount 56. Likewise, swivel shaft 40 is fixed as by welding at its lower end to sleeve 48 associated with beam 42. However, swivel shaft 40 is freely rotatable within sleeve 50 of bar 36 so that swivel head 38 can pivot right and left about the upright axis defined by shaft 40 relative to bar 36. In the illustrated embodiment, the upper sleeve 52 rests upon intermediate sleeve 50. It will be appreciated that in commercial practice, the manner of supporting swivel head 38 on bar 36 may vary from that illustrated in FIG. 4.

Power mechanism broadly denoted by the numeral 62 is provided for effecting swiveling movement of head 38. Such power mechanism 62 preferably takes the form of a pair of hydraulic swivel cylinders 64 and 66, each of which is connected at its rear end to base 34 and at its front end to the backside of mount 56. Cylinders 64, 66 are pivotally connected to mount 56 on opposite sides of pivot shaft 40 and are plumbed in such a manner that when one extends, the other retracts, and vice versa.

Swivel head 38 pivotally supports an elongated, transversely extending tool such as a blade 68 having a generally concave front side 70 and a generally convex backside 72. Transversely extending, horizontal pivots 74 and 76 pivotally mount the blade 68 on lugs 44, 46 for pivoting movement about a transverse, horizontal axis defined by the aligned pivots 74, 76. A pair of laterally spaced apart mounting ears 78, 80 are rigidly secured to the backside 72 of blade 68 and are joined with mounting lugs 44, 46 by pivots 74, 76 to accomplish the desired pivotal mounting of blade 68 to swivel head 38. Pivots 74, 76 are located in the lower half of blade 68 generally near the bottom extremity thereof.

Blade 68 is provided with a longitudinally extending top edge 82 and an opposite, longitudinally extending bottom edge 84. In the illustrated embodiment, top edge 82 and bottom edge 84 are defined by bolted-on, hardened strips 86 with continuous, beveled, longitudinal extremities, but other types of teeth or edge-presenting structure could be utilized instead.

Figure 6:
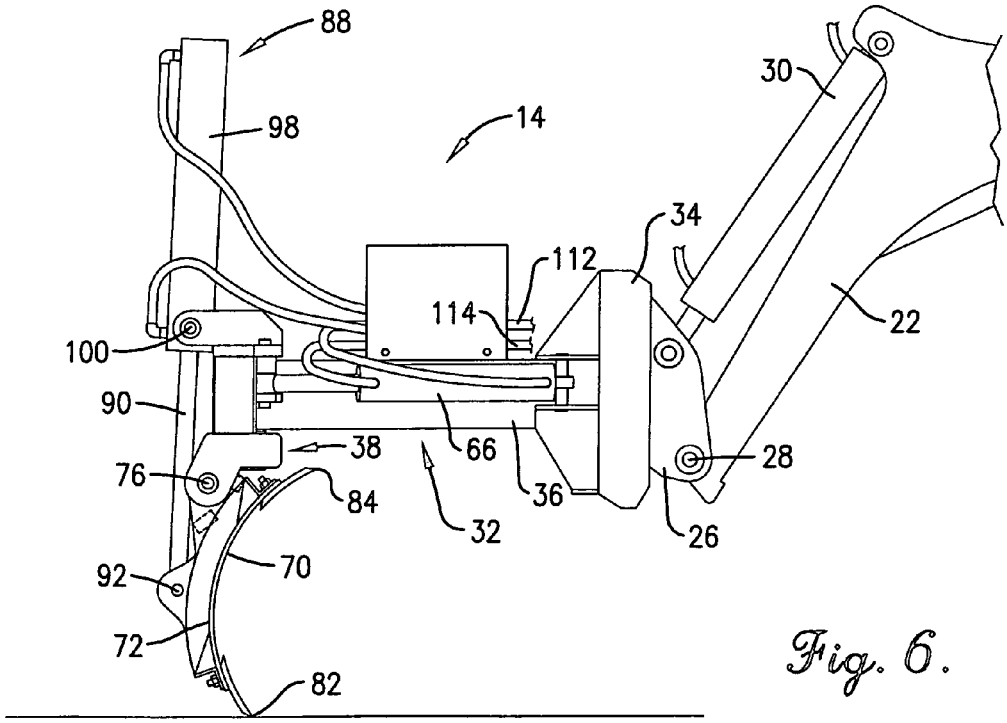
FIG. 6 is a fragmentary side elevational view similar to FIG. 5 but showing the blade fully flipped over into an inverted position.
Figure 7:
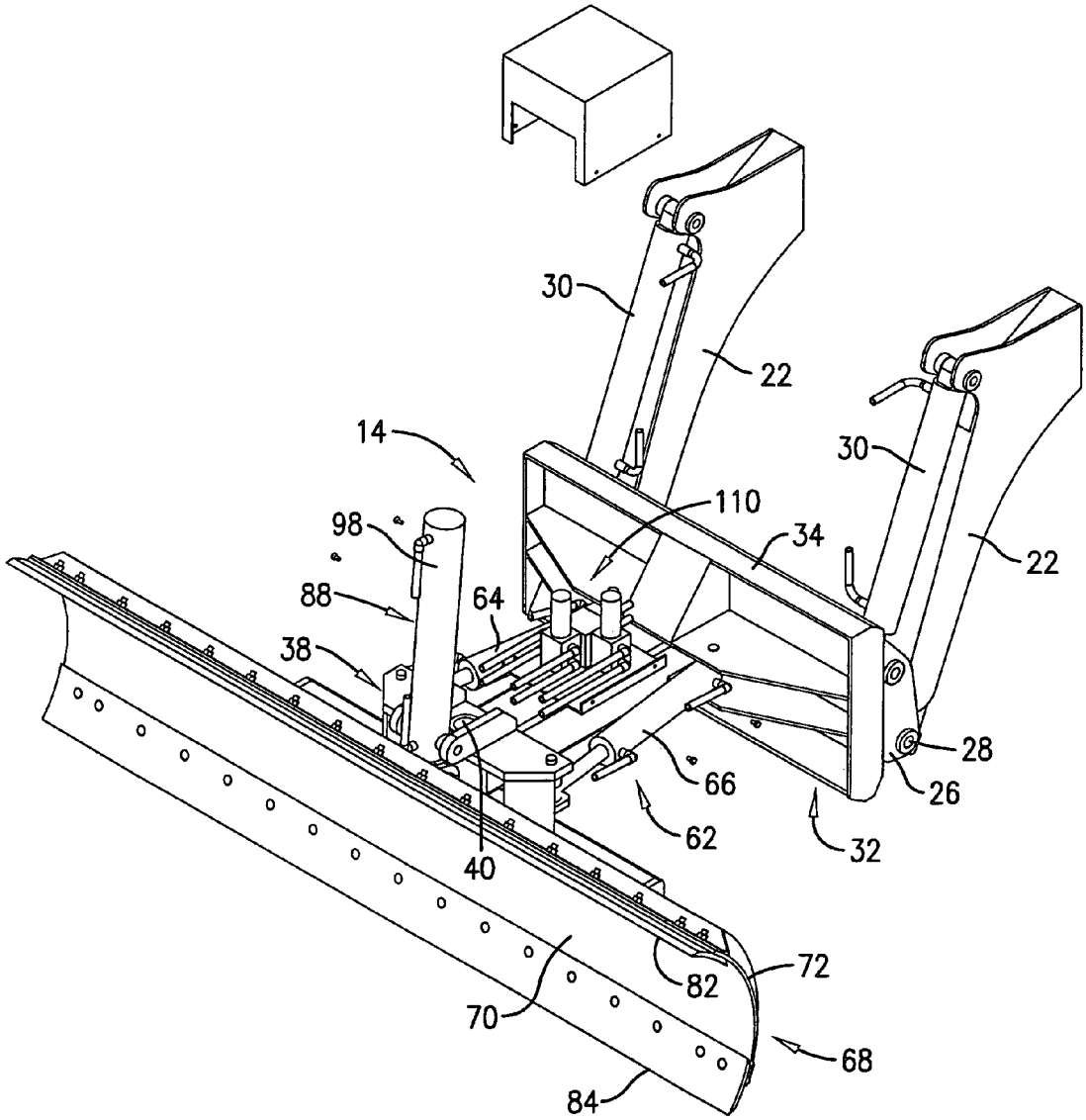
FIG. 7 is a left, front, top isometric view of the attachment and lift arms of the work vehicle with the protective housing of the hydraulic valve bank removed to reveal details of construction.
Figure 9:
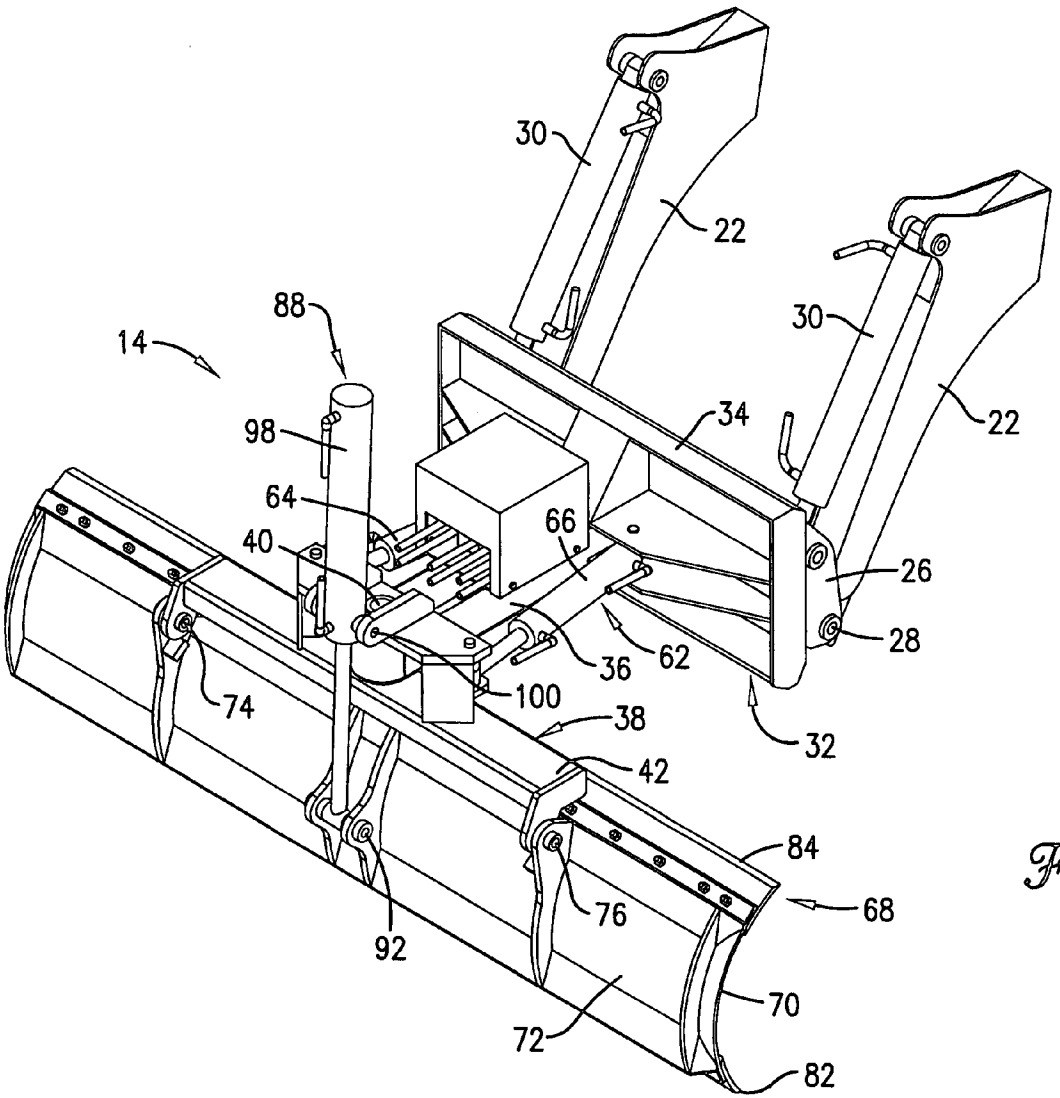
FIG. 9 is an isometric view similar to FIGS. 7 and 8 but showing the blade fully flipped over into its inverted position.
Figure 10:
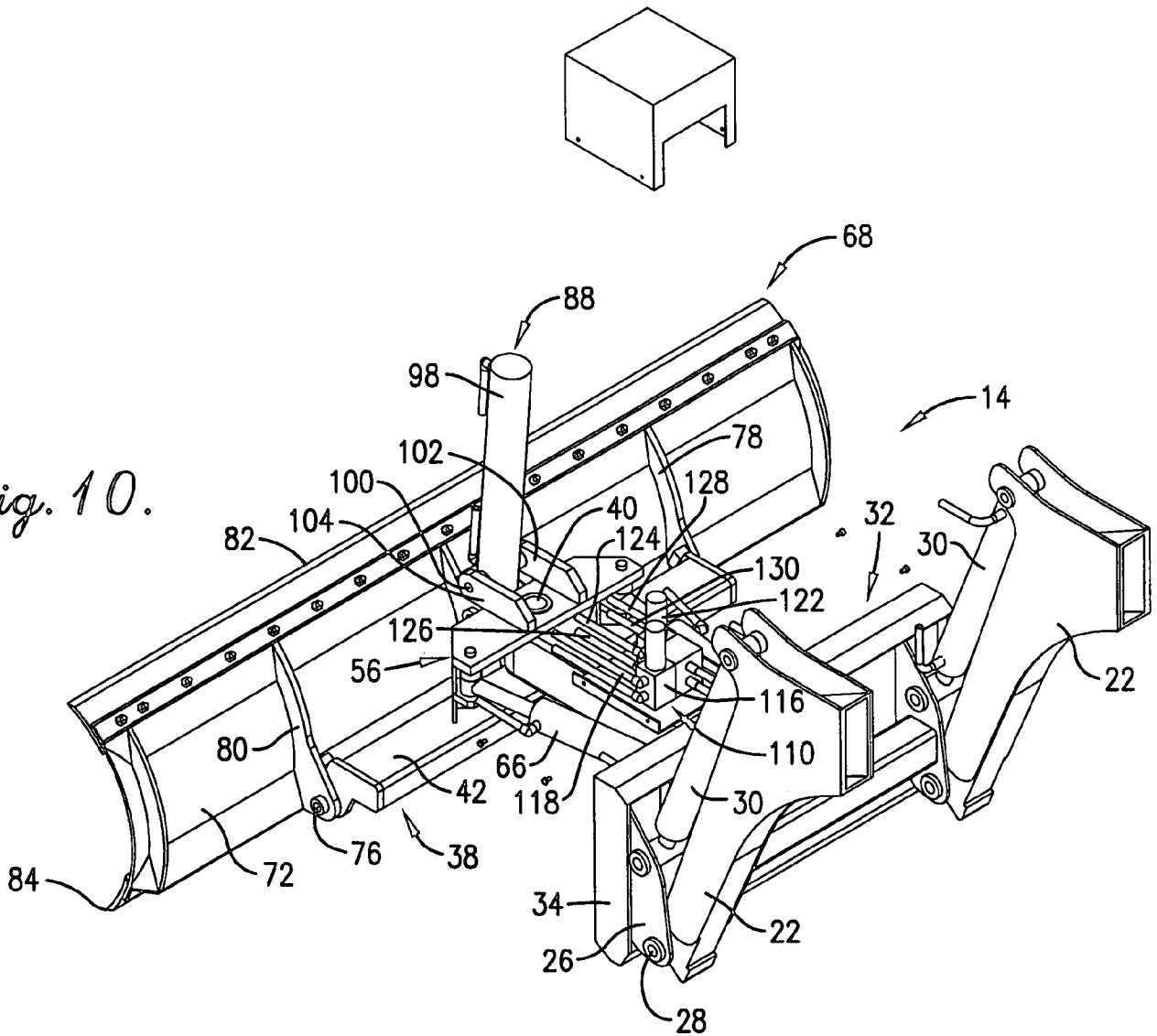
FIG. 10 is a top left rear isometric view of the attachment illustrating details of construction.

Blade 68 is adapted to be flipped over between an upright position as illustrated in FIG. 1 wherein top edge 82 is above bottom edge 84 and an inverted position as illustrated in FIGS. 6 and 9 wherein top edge 82 is below bottom edge 84. It will also be appreciated that in its upright position, the front side 70 of blade 68 faces forwardly and backside 72 faces rearwardly with respect to the normal direction of travel of vehicle 12. On the other hand, when blade 68 is in its inverted position, backside 72 faces forwardly and front side 70 faces rearwardly. A power device in the form of a hydraulic piston and cylinder unit 88 is operably coupled between support 32 and blade 68 for effecting flip-over movement of blade 68 between its upright and inverted positions.

More particularly, it will be seen that flip cylinder 88 has a rod 90 provided with a pivot connection 92 with a pair of ribs 94, 96 fixed to the backside 72 of blade 68. The generally upright barrel 98 of flip cylinder 88 has a pivot connection 100 at its rod end with a pair of laterally spaced and forwardly projecting mounting lugs 102 and 104 fixed to top plate 54 of mount 56 of swivel head 38. A pair of spaced apart Limit stops 106, 108 are fixed to the inboard surfaces of ears 78, 80 for the purpose of engaging front and rear extremities of lugs 44,46 at alternate extreme positions of blade 68 to prevent flip cylinder 88 from moving blade 68 past its upright position of FIG. 1 at one extreme and its inverted position of FIG. 6 at the other extreme. Due to stops 106, 108, the pivotal connection 92 of flip cylinder 88 with blade 68 is prevented from going over center with respect to pivots 100 and 74, 76 during flipping of blade 68 between its two extreme positions. As illustrated in FIGS. 1 and 6, pivotal connection 92 is located between pivot 100 and pivot 76 (measured vertically) when blade 68 is in its upright position of FIG. I and is located below pivot 76 (measured vertically) when blade 68 is in its inverted position of FIG. 6, although pivotal connection 92 is not aligned vertically with pivots 100 and 76 in either position.

In a preferred embodiment the swivel cylinders 64, 66 and flip cylinder 88 are remotely operated from the driver's seat by connection with onboard hydraulic circuitry and controls (not shown) associated with vehicle 12 and typically used for other attachments. In this respect hydraulic fluid under pressure is supplied from the vehicle 12 to a valve bank 110 carried on support bar 36 of attachment 14 via hydraulic lines 112 and 114. A first solenoid-actuated valve 116 of bank 110 controls lines 118 and 120 connected to opposite ends of flip cylinder 88, while a second solenoid-actuated valve 122 controls the flow of pressurized fluid to and from swivel cylinders 64, 66. Valve 122 has four lines, 124, 126, 128 and 130 that are fluidically connected to swivel cylinders 64, 66 for controlling the extension and retraction of those cylinders. As earlier noted, cylinders 64, 66 are plumbed such that when cylinder 64 extends, cylinder 66 retracts, and vice versa.

The solenoids associated with valves 116 and 122 are electrically connected via a wiring harness (not shown) with switches at the operator's platform 20. One suitable valve bank, set of hoses, and wiring harness for operating flip cylinder 88 and swivel cylinders 64, 66 are available in the form of an accessories kit from Bobcat Company of West Fargo, N.Dak. as an accessories kit for remotely operating a six-way blade, numbers 6674417, 6665869, and 6733136. Parts are also available from Hydra Force Inc. as number JEM950831-A 04/25.

OPERATION

Figure 3:
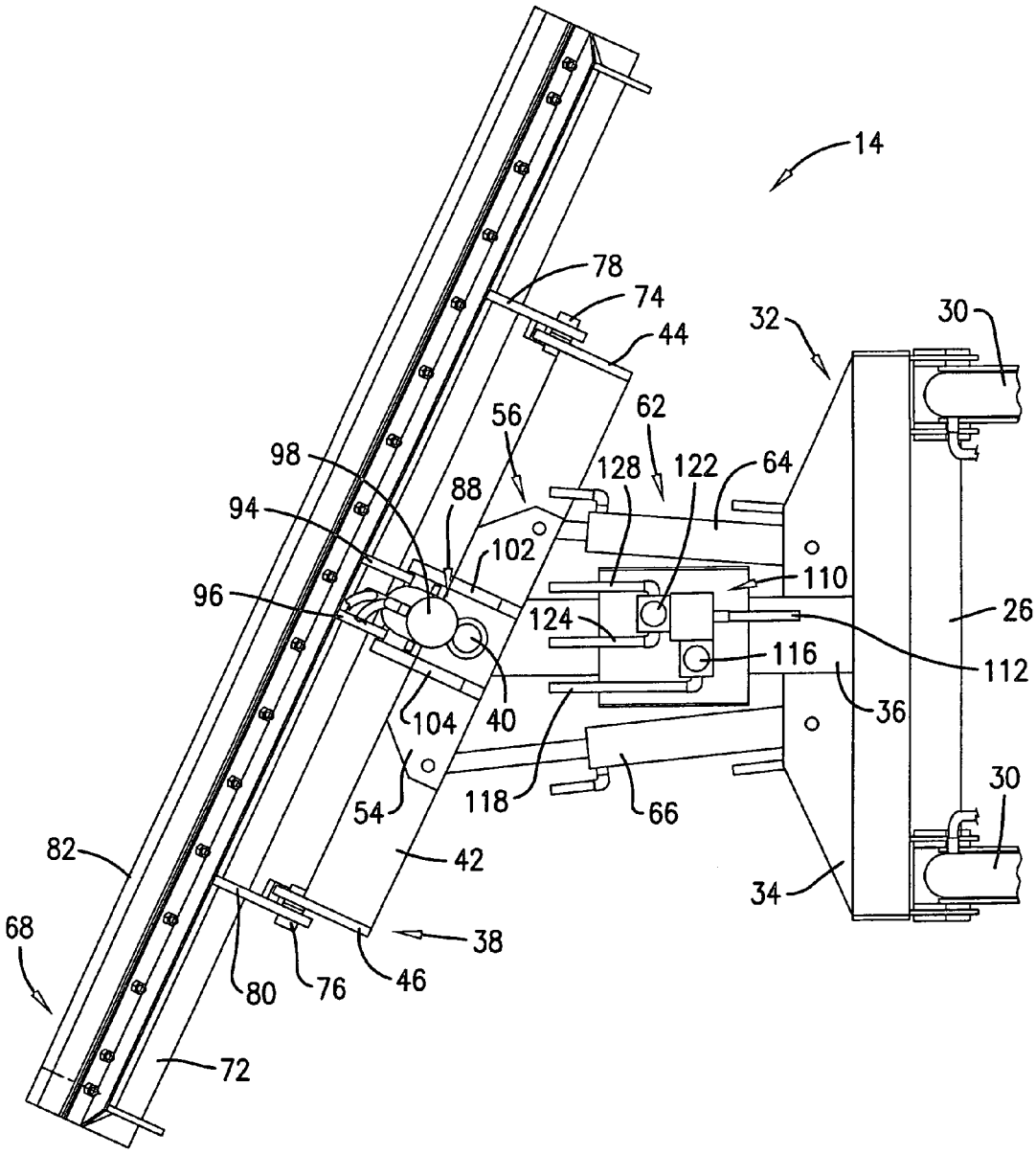
FIG. 3 is a top plan view similar to FIG. 2 but showing the manner in which the blade can be swivelled right and left between obliquely disposed positions.

With blade 68 in its upright position of FIGS. 1-4 and 7, vehicle 12 may be driven forwardly so that blade 68 performs like a dozer blade, pushing soil or other materials ahead of vehicle 12. Cylinders 64, 66 may be actuated at this time to swivel blade 68 either to the right or left about the upright axis of swivel shaft 40 to place blade 68 in a number of different obliquely disposed positions as may be necessary or desirable. FIG. 3 illustrates a right oblique position.

On the other hand, if it is desired to use blade 68 in a back-dragging mode, the operator simply raises lift arms 22 slightly and extends flip cylinder 88 to the limit available by stops 108, causing blade 68 to assume the inverted position of FIGS. 6 and 9. Such inverted position is also shown in phantom in FIG. 4. The operator then merely drives vehicle 12 in reverse and uses blade 68 to draw or drag soil and other materials with it.

Figure 5:
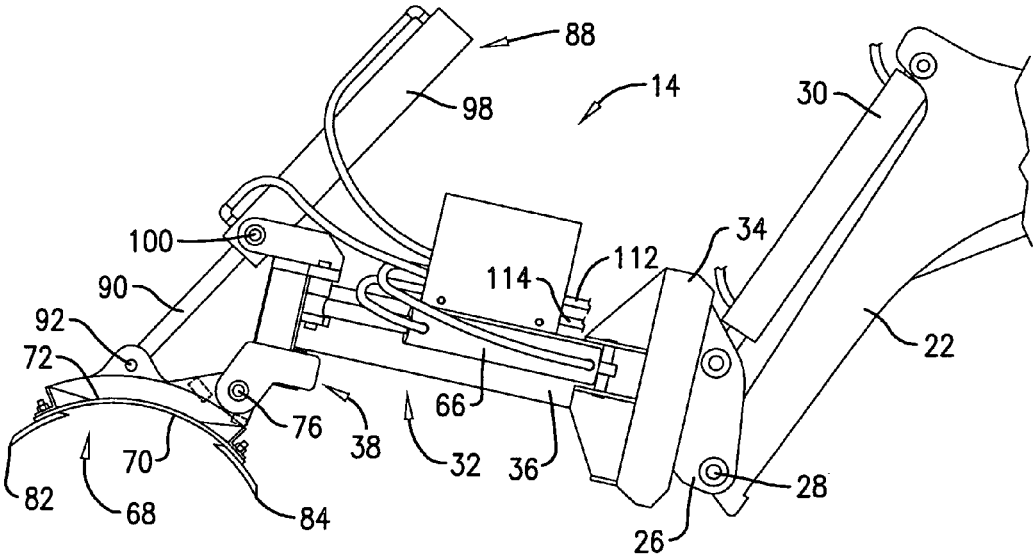
FIG. 5 is a fragmentary side elevational view of the work vehicle and blade attachment illustrating the blade in a partially flipped-over condition.
Figure 11:
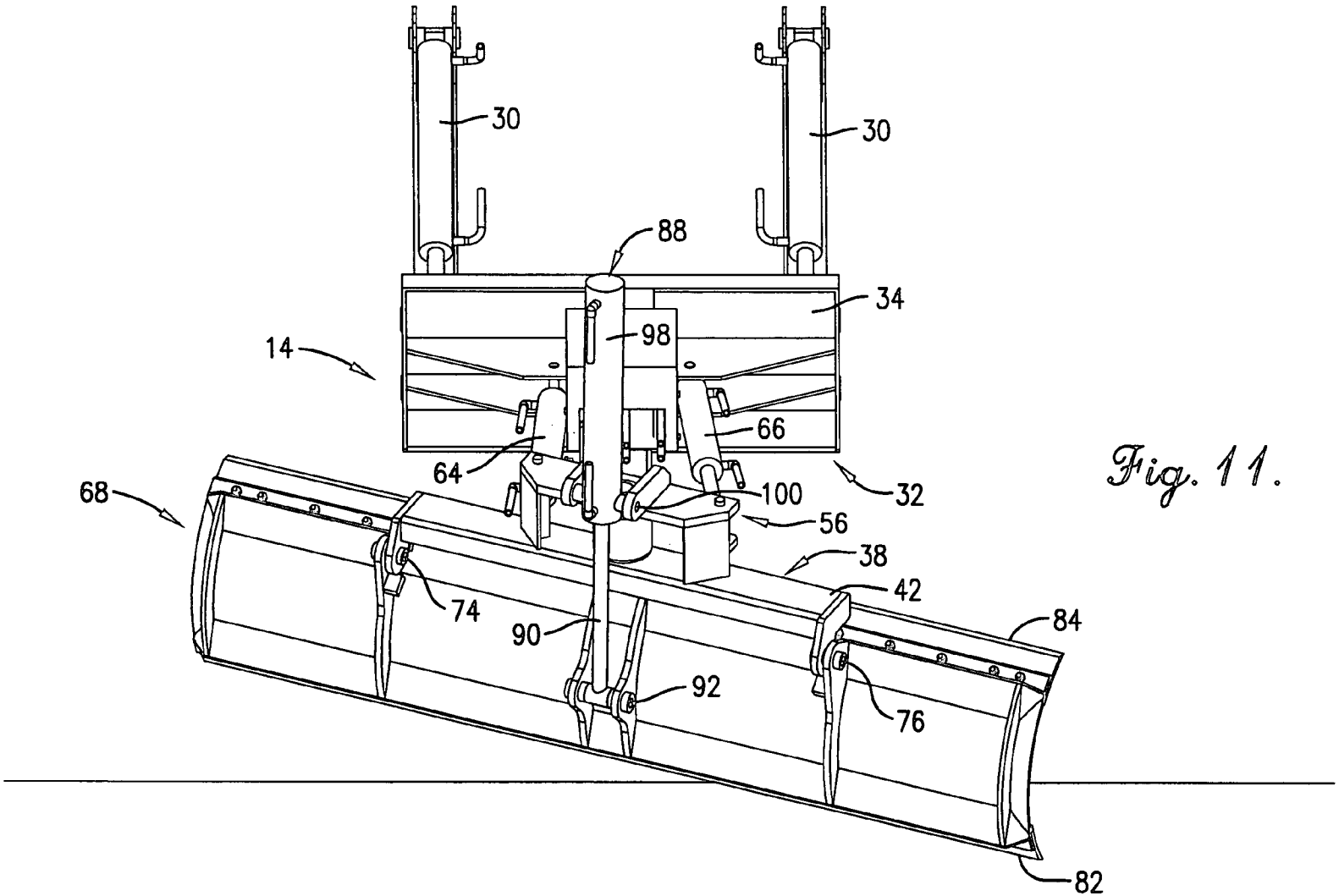

Manifestly, blade 68 may also be moved to any number of intermediate positions between its upright and inverted positions such as, for example, those intermediate positions illustrated in FIGS. 5 and 8. Because swivel head 38 can be freely swivelled left and right regardless of the position of blade 68, a wide range of useful positions for blade 68 can be achieved. For example, see FIG. 11 wherein blade 68 is inverted and also obliquely disposed in coordination with the height of lift arms 22 so as to enable one corner of blade 68 to drag through the soil. This can be especially useful, for example, in preparing shallow trenches.

It should thus be seen that the present invention provides an extremely versatile tool that is easy to use and highly effective. Moreover, it will be appreciated that while the flip-over blade has been illustrated by way of example as mounted on a particular kind of vehicle at its front end, the blade could also be incorporated as an attachment for the three-point hitch or other coupling arrangement at the rear of a tractor or other vehicle. This also greatly expands its versatility and usefulness. Furthermore, while the principles of the invention have been illustrated in connection with a blade 68, it will be appreciated that other forms of tools, such as buckets and box scrapers, for example, might be used instead of a blade.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

The invention claimed is:

1. In an attachment for a work vehicle, the improvement comprising:

a support;

a tool having a top transverse edge, a bottom, ground-engaging transverse edge, and a front face extending between said edges, said tool being mounted on said support for flip-over movement of the entire tool about a transverse axis between an upright position in which the top edge is above the bottom edge with the front face facing forwardly and an inverted position in which the top edge is below the bottom edge with the front face facing rearwardly; and a power device operably coupled with the tool for effecting said flip-over movement, said support including a stationary portion and a swivel head mounted on said stationary portion for left and right swivelling movement about an upright axis, said tool being mounted on said swivel head for left and right swivelling movement therewith between opposite, left and right obliquely disposed positions, further comprising power mechanism operably connected between the stationary portion and the swivel head for effecting said swivelling movement of the swivel head, said power device being connected between said swivel head and the tool, said power device comprising a double-acting, extendible and retractable, hydraulic piston and cylinder unit pivotally mounted on said swivel head at a first pivot, said piston and cylinder unit being pivotally connected to said tool at a second pivot, said tool being pivotally mounted on said swivel head at a third pivot spaced below said first pivot, said second pivot being disposed vertically between said first and third pivots when the tool is in its upright position and being disposed vertically below said third pivot when the tool is in its inverted position.

2. In an attachment as claimed in claim 1, said tool and said swivel head having interengageable stop structure disposed to prevent said second pivot from passing over-center with respect to said first and third pivots during operation of the piston and cylinder unit.

3. In an attachment for a work vehicle, the improvement comprising:

a support;

a tool having a top transverse edge, a bottom, ground-engaging transverse edge, and a front face extending between said edges, said tool being mounted on said support for flip-over movement of the entire tool about a transverse axis between an upright position in which the top edge is above the bottom edge with the front face facing forwardly and an inverted position in which the top edge is below the bottom edge with the front face facing rearwardly; and a power device operably coupled with the tool for effecting said flip-over movement, said support including a stationary portion and a swivel head mounted on said stationary portion for left and right swivelling movement about an upright axis, said tool being mounted on said swivel head for left and right swivelling movement therewith between opposite, left and right obliquely disposed positions, further comprising power mechanism operably connected between the stationary portion and the swivel head for effecting said swivelling movement of the swivel head, said swivel head including a transverse beam and a pair of mounting lugs at opposite ends of the beam, said tool being pivotally attached to the swivel head at said mounting lugs, said swivel head further including a mount on said beam pivotally attaching said power device to the swivel head at a point generally above and between said lugs, said power device being pivotally connected to said tool at a point generally between said lugs, said connection point of the power device to the tool being generally above the point of connection of the tool to the lugs when the tool is in its upright position and being generally below the point of connection of the tool to the lugs when the tool is in its inverted position.

4. In an attachment as claimed in claim 3, said mount and said beam supporting an upright pivot that is rotatably received by said stationary portion.

5. In an attachment as claimed in claim 1, said tool having a generally concave front side and a generally convex backside.

6. In an attachment as claimed in claim 1, said tool comprising a blade.

7. Ground-working apparatus comprising:

a mobile work vehicle capable of moving in a forward direction and a reverse direction; and an earth-working attachment mounted on said vehicle and comprising, a support;

a tool having a top transverse edge, a bottom, ground-engaging transverse edge, and a front face extending between said edges, said tool being mounted on said support for flip-over movement of the entire tool about a transverse axis between an upright position in which the top edge is above the bottom edge with the front face facing forwardly for pushing soil as the vehicle moves forwardly and an inverted position in which the top edge is below the bottom edge with the front fact facing rearwardly for pulling soil as the vehicle moves rearwardly; and a power device operably coupled with the tool for effecting said flip-over movement, said support including a stationary portion and a swivel head mounted on said stationary portion for left and right swivelling movement about an upright axis, said tool being mounted on said swivel head for left and right swivellmnn movement therewith between opposite, left and right obliquely disposed positions, further comprising power mechanism operably connected between the stationary portion and the swivel head for effecting said swivelling movement of the swivel head, said power device being connected between said swivel head and the tool, said power device comprising a double-acting, extendible and retractable, hydraulic piston and cylinder unit pivotally mounted on said swivel head at a first pivot, said piston and cylinder unit being pivotally connected to said tool at a second pivot, said tool being pivotally mounted on said swivel head at a third pivot spaced below said first pivot, said second pivot being disposed vertically between said first and third pivots when the tool is in its upright position and being disposed vertically below said third pivot when the tool is in its inverted position.

8. Ground-working apparatus as claimed in claim 7, said tool and said swivel head having interengageable stop structure disposed to prevent said second pivot from passing over-center with respect to said first and third pivots during operation of the piston and cylinder unit.

9. Ground-working apparatus comprising:

a mobile work vehicle capable of moving in a forward direction and a reverse direction; and an earth-working attachment mounted on said vehicle and comprising, a support;

a tool having a top transverse edge, a bottom, ground-engaging transverse edge, and a front face extending between said edges, said tool being mounted on said support for flip-over movement of the entire tool about a transverse axis between an upright position in which the top edge is above the bottom edge with the front face facing forwardly for pushing soil as the vehicle moves forwardly and an inverted position in which the top edge is below the bottom edge with the front fact facing rearwardly for pulling soil as the vehicle moves rearwardly; and a power device operably coupled with the tool for effecting said flip-over movement, said support including a stationary portion and a swivel head mounted on said stationary portion for left and right swivelling movement about an upright axis, said tool being mounted on said swivel head for left and right swivelling movement therewith between opposite, left and right obliquely disposed positions, further comprising power mechanism operably connected between the stationary portion and the swivel head for effecting said swivelling movement of the swivel head, said swivel head including a transverse beam and a pair of mounting lugs at opposite ends of the beam, said tool being pivotally attached to the swivel head at said mounting lugs, said swivel head further including a mount on said beam pivotally attaching said power device to the swivel head at a point generally above and between said lugs, said power device being pivotally connected to said tool at a point generally between said lugs, said connection point of the power device to the tool being generally above the point of connection of the tool to the lugs when the tool is in its upright position and being generally below the point of connection of the tool to the lugs when the tool is in its inverted position.

10. Ground-working apparatus as claimed in claim 9, said mount and said beam supporting an upright pivot that is rotatably received by said stationary portion.

11. Ground-working apparatus as claimed in claim 9, said power device comprising a double-acting, hydraulic piston and cylinder unit.

12. Ground-working apparatus as claimed in claim 9, said tool having a generally concave front side and a generally convex backside.

13. Ground-working apparatus as claimed in claim 9, said tool comprising a blade.

* * * * *